United States Patent [19]

Schuster

[11] Patent Number: 5,020,668

[45] Date of Patent: Jun. 4, 1991

[54] SLEEVE-TYPE CARRIER WITH INTEGRAL ALIGNMENT FEATURE

[75] Inventor: Richard L. Schuster, Monroe, La.

[73] Assignee: Manville Corporation, Denver, Colo.

[21] Appl. No.: 417,343

[22] Filed: Oct. 5, 1989

[51] Int. Cl.[5] ..... B65D 5/02

[52] U.S. Cl. ..... 206/427; 229/40; 229/900

[58] Field of Search ..... 206/141, 161, 193, 429, 206/427, 147, 155; 229/900, 40, 120.14

[56] References Cited

U.S. PATENT DOCUMENTS

| | | | |
|---|---|---|---|
| 4,022,372 | 5/1977 | Graser | 229/40 |
| 4,131,230 | 12/1978 | Koehlinger et al. | 229/40 |
| 4,300,679 | 11/1981 | Benzschawel et al. | 229/40 X |
| 4,398,631 | 8/1983 | Graser | 206/141 X |
| 4,588,084 | 5/1986 | Holley, Jr. | 229/40 X |
| 4,830,267 | 5/1989 | Wilson | 206/141 |

*Primary Examiner*—Paul T. Sewell
*Assistant Examiner*—Jacob K. Ackun, Jr.
*Attorney, Agent, or Firm*—John D. Lister; Cornelius P. Quinn

[57] ABSTRACT

An enclosed article carrier having upper sloping and panels to conform to the shape of the end articles in the carrier. The end panels are comprised of dust flaps adhered to overlapping upper and lower end flaps. Each dust flap is connected to the adjacent edge of its side panel along angled fold lines, the bottom edge of the dust flap being connected to the side panel adjacent the bottom panel of the carrier. Each dust flap has a cutout extending from its outer edge to a point spaced from the juncture of the fold lines. The carriers are thus strong enough to resist bowing during loading, resulting in well-aligned end panel flaps.

12 Claims, 3 Drawing Sheets

SLEEVE-TYPE CARRIER WITH INTEGRAL ALIGNMENT FEATURE

FIELD OF THE INVENTION

This invention relates to sleeve-type article carriers having closed end panels. More particularly, it relates to carriers of this type whose end panels have an angled portion in order to follow the contours of the packaged articles.

BACKGROUND OF THE INVENTION

Sleeve-type paperboard carriers are commonly used to package beverage containers. They are conventionally shipped to bottling facilities in the form of collapsed carrier sleeves which are opened to sleeve or tubular shape so that the open ends of the sleeves face outwardly during travel through a packaging machine. Beverage containers are then introduced to the sleeve through the open ends, after which the ends are closed by overlapping end flaps.

One type of carrier formed in this manner is adapted to carry conventionally shaped bottles having relatively long narrow necks. In order to tightly package the bottles the end panels of the cartons are formed so that they generally conform to the shape of the adjacent bottles, with the lower portion of the end panels extending vertically from the bottom panel and the upper portion of the end panels extending at an angle to the top panel so as to follow the tapered necks of the end bottles. To achieve this configuration the ends of the side panels of the carrier are shaped according to the particular end slope desired. Overlapping end flaps connected to the ends of the top and bottom panels are adhered to dust flaps which are connected along fold lines to the angled end edges of the side panels.

Although this arrangement produces a tightly bound package of beverage bottles, the angled design of the end panel is highly susceptible to misalignment of the flaps forming the end panel. A major cause of the problem is the tendency of the side panels to bow outwardly as the opened sleeve is pushed into the packaging machine, apparently due to the inability of the side panels to resist the vertical forces to which the sleeves are subjected during this operation. As a result, the carrier is not only slightly weakened, but its appearance can suffer greatly. Usually, a package of this type contains photographs, illustrations, legends or other indicia on the side panels. To present a unified appearance the overlapping end panel flaps must be precisely aligned so that the indicia on the end panels do not appear to be broken by the composite flaps. If the side panels are bowed at the time the flaps are adhered to the dust flaps and to each other, the resulting carrier will be out-of-square and the end panel indicia will exaggerate the flap misalignment. Because this is not consistent with the quality appearance desired of the package it is a problem that should be resolved. Prior to this invention, however, it did not appear possible to correct the situation without changing the basic sloped end panel shape or resorting to the use of thicker paperboard stock or expensive reinforced paperboard.

It is therefore an object of the invention to provide a sleeve-type carrier of the type described which does not have a tendency for the end panel flaps to be misaligned.

BRIEF SUMMARY OF THE INVENTION

In accordance with the invention, an integral dust flap is connected to the angled end edge portions of each of the side panels, and a cutout provided in the dust flap extends in toward the fold line connecting the dust flap to the side panel. The cutout terminates at a point which is close enough to the fold line to permit the dust flap to be folded in about the fold line but is spaced sufficiently to strengthen the side panel against a force tending to bow the side panels. Preferably, the cutout terminates at a point relatively close to the juncture of the angled segments of the fold line connecting the dust flap to the end edge of the side panel. A further preferred arrangement is for the spacing from the end of the cutout to the juncture to be less than half the distance from the juncture to the end edge of the dust flap opposite the fold line. If desired, the portion of the dust flap between the juncture of the angled segments of the fold line and the cutout may contain a score line or a cut to facilitate folding of the dust flaps.

Because this arrangement strengthens the carrier sleeve to the point that it resists bowing when introduced into the packaging machine, the resulting straight side panels allow the dust flaps and the overlapping end flaps to be properly aligned.

The above and other aspects of the invention, as well as other benefits, will readily be ascertained from the more detailed description of the preferred embodiment of the invention which follows.

DESCRIPTION OF THE PREFERRED EMBODIMENTS

Figure 1:
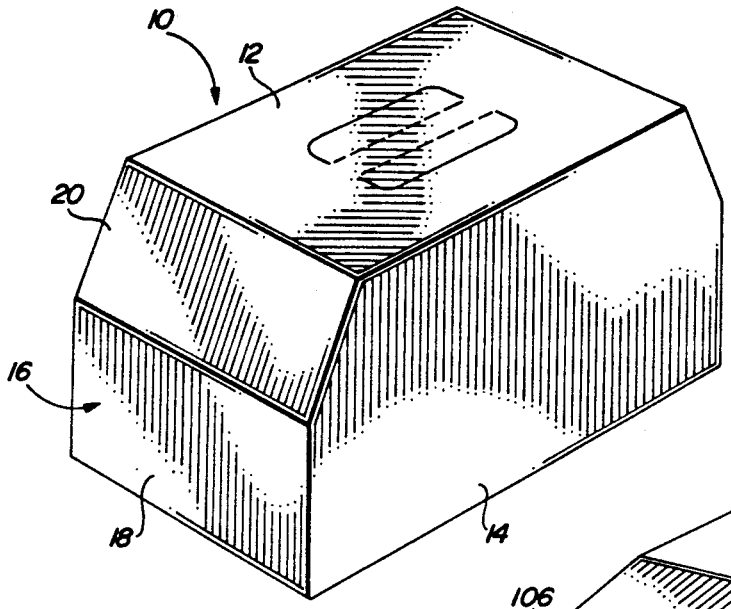
FIG. 1 is a pictorial view of a sleeve-type carrier incorporating the present invention.

Referring to FIG. 1, a carrier 10 embodying the features of the invention comprises a top panel 12, a bottom panel not visible in this view, side panels 14 connecting the top and bottom panels and end panels 16 connecting the top, side and bottom panels. Each end panel is made up of a lower vertical portion 18, which is substantially perpendicular to the bottom panel, and an upper angled portion 20 which extends from the lower vertical portion 18 to the top panel 12. The lower portion of each side panel is longer than the upper side panel portion in order to correspond to the contour of the end panels to which the side panels are connected. The top panel 12, which connects the short upper edge of the side panels, is correspondingly shorter than the bottom panel, which connects the longer lower edge of the side panels.

Figure 2:
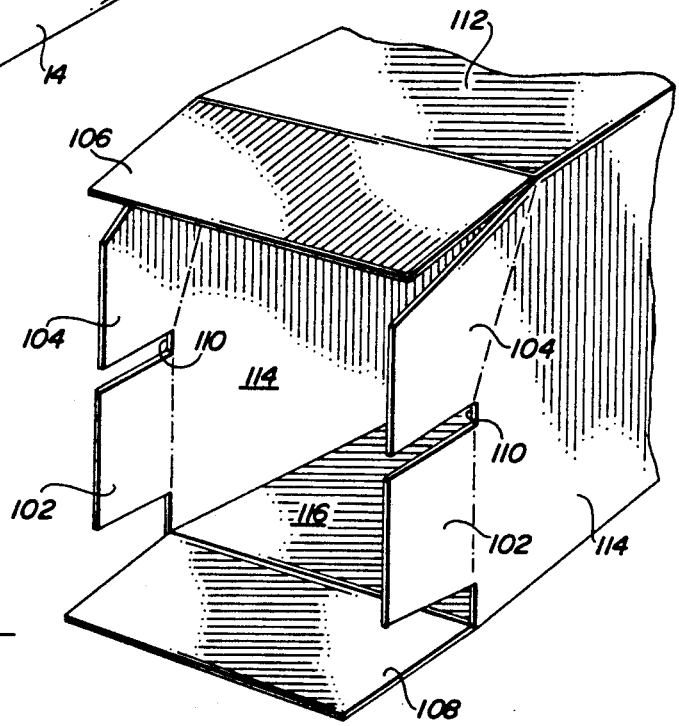
FIG. 2 (PRIOR ART)
FIG. 2 is a partial pictorial view of a prior art carrier sleeve, showing an open end thereof.

In order to better understand the problem facing prior art carriers of similar shape, a typical prior art sleeve adapted to be formed into a carrier of substantially the same shape as the carrier of FIG. 1 is shown in FIG. 2. The prior art sleeve comprises a lower dust flap 102 foldably connected to the lower vertical edge of each of the side panels 114 and an upper dust flap 104 foldably connected to the upper angled edge of the side panels 114. In forming a carrier from the sleeve, the dust flaps 102 and 104 are folded in after the sleeve has been loaded with beverage bottles and the upper and lower end flaps 106 and 108, which are connected to the top and bottom panels 112 and 116, are folded and glued to the folded-in dust flaps. Typically, the upper end flap 106 is longer than the lower end flap 108 and will be folded down first. It is then glued to the upper dust flaps 104 and to the upper portion of the lower dust flaps 102 prior to the lower end flap 108 being folded up. The lower end flap 108 overlaps the end flap 106 and is glued to both the lower dust flaps 102 and to the overlapped portion of the upper end flap 106.

Figure 3:
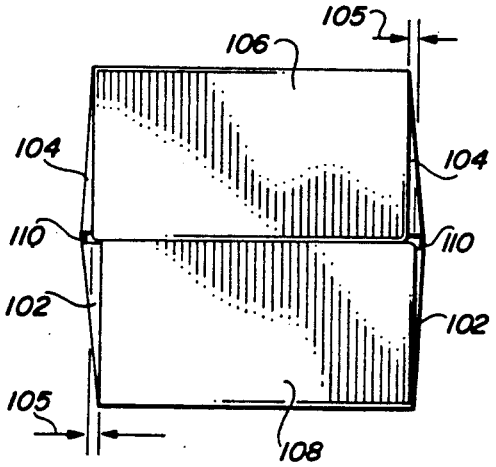
FIG. 3 (PRIOR ART)
FIG. 3 is an end view of a prior art carrier formed from the sleeve of FIG. 2.

The areas 110 at the edge of the side panels 114 between the dust flaps 102 and 104 tend to buckle when a vertical force is applied to the carrier of the magnitude routinely applied in the course of the carrier sleeve being introduced to a packaging machine. Similarly, the side panels tend to be bent or bowed outwardly adjacent the intersection of the bottom panel 116 and the lower end flap 108 when a vertical force of the same magnitude is applied to the carrier. It can be seen that this area of the side panel is unsupported due to the spacing of the lower dust flaps 102 from the bottom panel 116 in order to be able to clear certain elements of the packaging machine during travel of the carrier sleeve through the packaging machine. When the side panels become distorted due to the buckling and bowing action described, the subsequent folding and gluing of the dust flaps and the end flaps after bottles have been loaded into the carrier often results in the package being permanently misaligned, as illustrated in FIG. 3 and as graphically indicated by the lateral dimension arrows 105. It can be seen from FIG. 3 that the side panels 114 have been fixed in their bowed position, with portions of the dust flaps 102 and 104 being visible. This causes the end flaps 106 and 108 to be misaligned so that any indicia on these flaps intended to be part of an overall composite indicia covering the entire end panel will be misaligned as well, destroying the intended visual impact.

Figure 4:
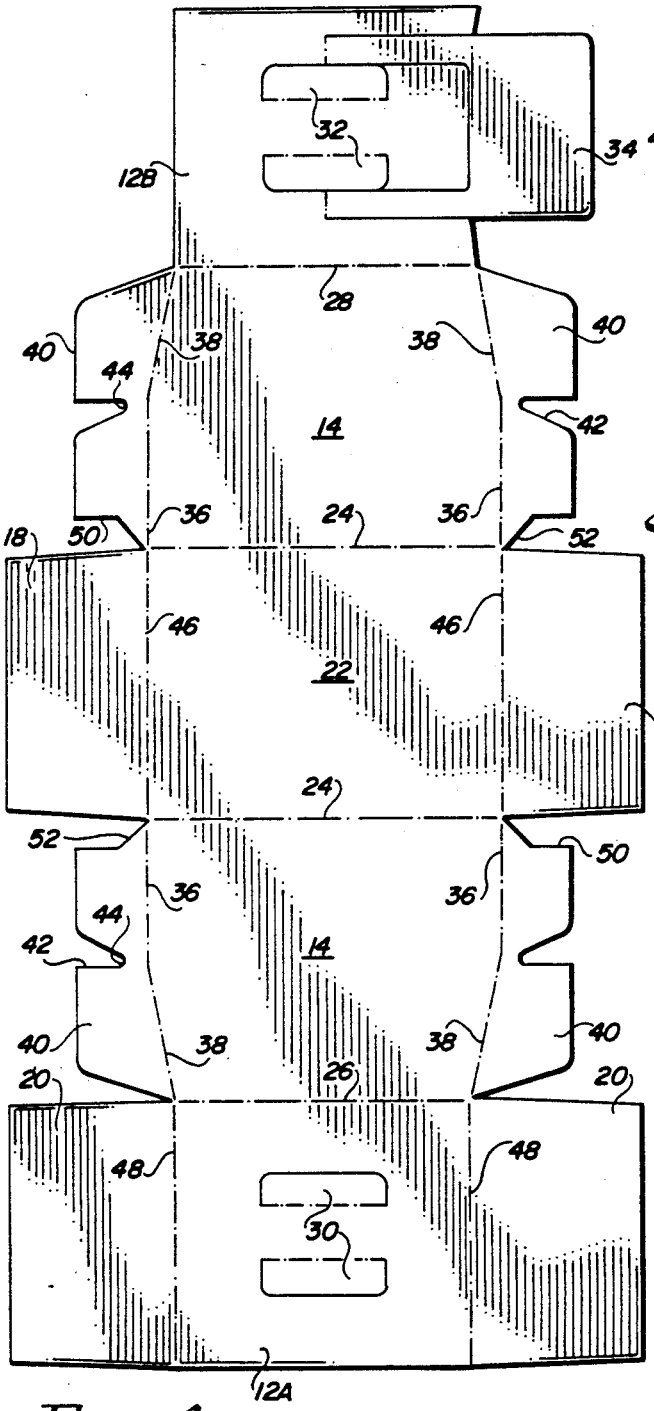
FIG. 4 is a plan view of a blank used to form the carrier of the present invention.

The problems of the prior art carriers are solved by the present invention which is shown in blank form in FIG. 4. The blank is comprised of a bottom panel section 22 connected along its side edges by fold lines 24 to the side panel sections 14. A top panel section 12A is connected along its interior edge by fold line 26 to the adjacent side panel 14. Another top panel section 12B is connected along its interior edge by fold line 28 to the other side panel section 14. The top panel section 12A is adapted to overlie and be adhered to the top panel section 12B. Handle openings may be provided in the top panel of the carrier formed from the blank by aligned openings in the top panel sections, indicated by the tabs 30 which cover the openings in the section 12A and the tabs 32 which cover the openings in the section 12B. The underlying top panel section 12B may also be provided with a hinged drop-down divider panel 34 to separate bottles in the carrier. Since neither the handle nor the divider panel affects the functioning of the present invention, the provision of such a divider panel is optional and the particular design of the handle is a matter of choice unrelated to the invention.

It can be seen from FIGS. 1 and 4 that the fold lines 24 are longer than the fold lines 26 and 28, causing the top panel formed by the sections 12A and 12B to be shorter than the bottom panel 22. This is necessary due to the inwardly directed angled portion of the end panels of the carrier. The shape of the end panels is delineated by the edges of the side panels, whereby the lower portion of the end panels of a carrier formed from the blank is defined by the side panel edges 36 extending at right angles from the fold lines 24, and the upper sloped portion of the end panels is defined by the angled side panel edges 38 connecting the edges 36 to the fold lines 26 and 28.

A dust flap 40 is connected to each end edge of the side panel sections 14 along a fold line corresponding to the side panel edges 36 and 38. Each dust flap contains a cutout 42 which terminates in a radius or arcuate portion 44 spaced from and in the vicinity of the juncture between the fold line segments corresponding to the edges 36 and 38. End flaps 18 are connected to the end edges of the bottom panel section 22 along fold lines 46 and end flaps 20 are connected to the end edges of the top panel section 12A along fold lines 48. The portion of the dust flaps 40 connected to the fold line 38 extends to the intersection of the fold lines 38 and 26, providing support for the side panel edges up to the top panel. The portion of the dust flaps connected to the fold line 36 extends to the intersection of the fold lines 36 and 24, providing support for the side panels down to the bottom panel 22. Thus there is an unbroken connection between each dust flap and its associated side panel.

Although the dust flaps 40 extend all the way to the fold line 24 connecting the side panels to the bottom panel, it will be noted that the bottom edges 50 of the dust flaps are spaced from the end flaps 18 to allow for the carrier sleeve to pass through the packaging machine without being interfered with by any of the elements of the machine. The spaced edge 50 is connected to the intersection of the fold lines 36 and 24 by diagonal edge 52 which permits the edge 50 to be spaced from, while at the same time providing for side panel support at, the bottom of the side panel.

To form a collapsed carrier sleeve from the blank of FIG. 4 the top panel section 12B is folded about fold line 28 so as to be in face-to-face relationship with the adjacent side panel 14. The other side panel 14 is then folded up about its fold line 24, causing the top panel section 12A to directly overlie the folded top panel section 12B. By gluing the top panel sections to each other in areas that adhere the two sections together without bonding the top panel section 12A to the divider panel 34, the divider panel will be free to pivot down into place upon opening the collapsed sleeve.

Figure 5:
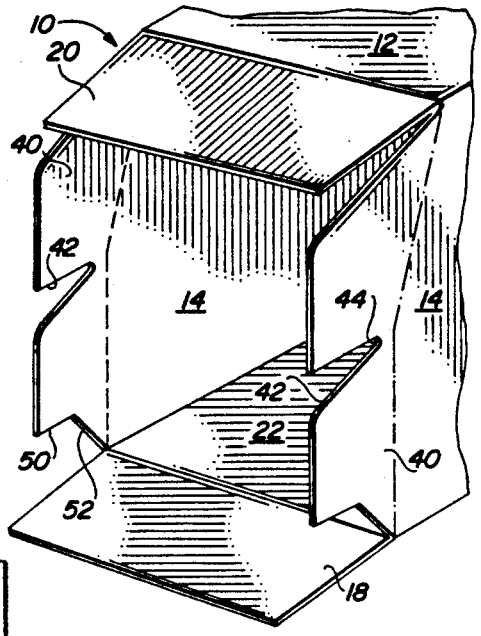
FIG. 5 is a partial pictorial view of the carrier sleeve of the present invention, showing an open end thereof.
Figure 6:
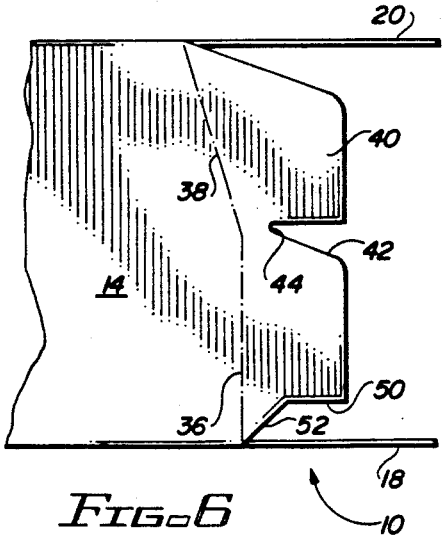
FIG. 6 is a partial side view of the carrier sleeve of the invention, showing the dust flap in open condition prior to being folded in during the forming of the end panel.

In the packaging machine the collapsed sleeve is opened into the tubular shape of FIG. 5, with the dust flaps 40 and the end flaps 18 and 20 extending out from the side, top and bottom panels. The full support provided the side walls 14 by the connected dust flaps 40 is further illustrated in FIG. 6, which shows the upper portion of the dust flap connected to the fold line segment 38 up to the top panel 12 and the lower portion of the dust flap connected to the fold line segment 36 down to the bottom panel 22. It is in this condition, prior to being loaded with bottles, that the carrier sleeve is most vulnerable to vertical forces causing the bowing or buckling of the side panels 14. As stated above, the critical area at the bottom of the side panels is strengthened by the connection of the dust flaps to the side panels down to the bottom panel. The critical area between the vertically spaced dust flaps of the prior art is eliminated by making the upper and lower segments of the dust flap 40 integral and by connecting the integral dust flap 40 to both of the fold line segments 36 and 38 even though the fold line segments extend in different directions. By eliminating the gap in the prior art arrangement at the juncture of the fold lines 36 and 38, the side panels are strengthened in this area and as a result they resist buckling when exposed to the normal vertical stresses in the packaging machine. The best location of the end 44 of the cutout 42 may vary according to the specific design of the carrier, but it should be far enough from the dust flap fold line to allow significant strengthening of the side panels but not so far that the width of the dust flap at that point interferes with the inward folding of the dust flaps. As an example, it has been found that a spacing of ½ inch adequately strengthens the side panels without interfering with the folding of the dust flaps.

Figure 7:
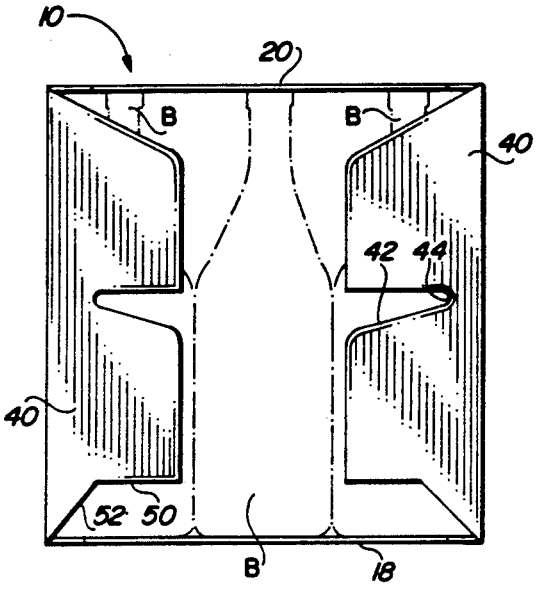
FIG. 7 is an end view of the carrier sleeve of FIG. 6, showing the dust flaps in folded condition.
Figure 8:
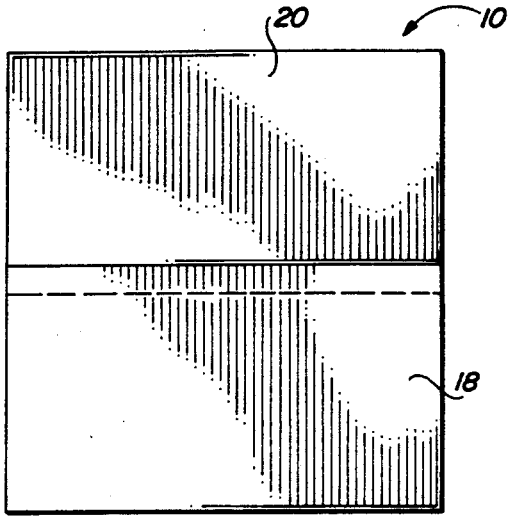
FIG. 8 is an end view of a carrier formed from the sleeve of FIG. 7.

After the sleeve has been loaded, the dust flaps are then folded in about their fold lines 36 and 38. The sleeve appears from an end view as shown in FIG. 7, which shows the end bottles B of a carrier designed to hold three rows of four bottles each. The side panels are straight and have not been distorted. The same view after the end flaps 18 and 20 are folded into place and glued is shown in FIG. 8, wherein the fully packaged and closed carrier is illustrated as being effectively squared-up, with the end panels being in proper alignment. In this condition, any indicia on one end panel flap intended to be a continuation of indicia on the other end panel flap is properly aligned, and the adhered end flaps give the appearance of a single end panel.

Figure 9:
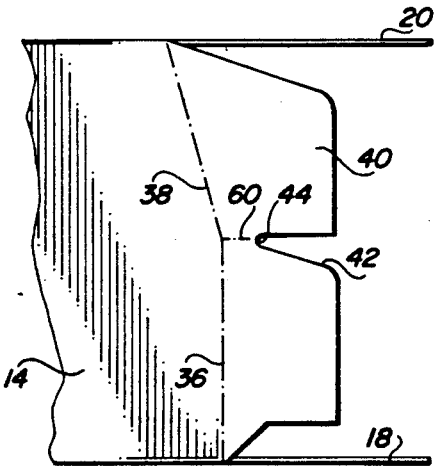
FIG. 9 is a view similar to that of FIG. 6, but showing a modified dust flap.
Figure 10:
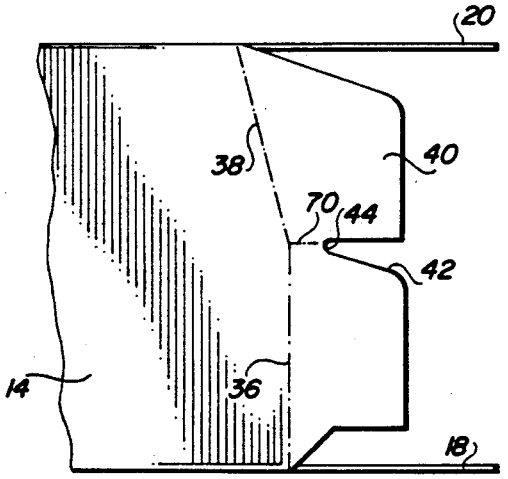
FIG. 10 is a view similar to that of FIG. 6, but showing another modified dust flap.

Referring to FIG. 9, wherein like reference numerals to those discussed in connection with FIGS. 1 and 4 to 8 refer to like elements, the dust flap 40 has been provided with a score line 60 extending from the intersection of the fold lines 36 and 38 to the end 44 of the cutout 42. This is for the purpose of facilitating the folding action of the dust flaps in order to overcome any tendency for the dust flaps to wrinkle or fold in this area. This may be especially useful if it is desired to maximize the width of the dust flap between the fold line intersection and the cutout to obtain greater resistance to bowing and buckling without creating problems in the dust flap itself due to the greater width. Similarly, the arrangement of FIG. 10, wherein a cut or slit 70 is provided between the fold line intersection and the end of the cutout instead of a score line, may be used for the same purpose.

It will now be understood that the invention enables a carrier of the same shape and size as those of the prior art to be utilized without the danger of end panel misalignment and the accompanying problems detailed above. The invention involves only slight changes from the point of view of carrier blank production and does not require extra blank material. As a result the invention does not increase the expense of the carrier.

It should now be apparent that although the invention has been described in connection with the preferred embodiments, it is contemplated that those skilled in the art may make changes to certain features of the preferred embodiments without altering the overall basic function and concept of the invention and without departing from the spirit and scope of the invention, as defined in the appended claims.

What is claimed is:

1. In a sleeve-type article carrier adapted to carry articles having relatively narrow upper portions and relatively wide lower portions, wherein the carrier comprises a relatively short top panel, a relatively long bottom panel, side panels foldably connected to the top and bottom panels, the side panels having lower end edge portions and upper end edge portions extending at an angle to each other and intersecting each other so that the distance between the lower end edge portions of a side panel is greater than the distance between the upper end edge portions thereof, an improved end panel structure connecting the top, bottom and side panels at each end of the carrier, comprising:

a dust flap connected to the angled upper and lower end edge portions of each side panel along a correspondingly angled fold line;

an upper end flap foldably connected to the bottom panel and adhered to the adjacent dust flaps;

each dust flap having an upper edge, a lower edge and an end edge opposite said angled fold line; and the end edge of each dust flap containing a cutout extending toward the angled fold line and terminating at a point spaced from the intersection of the upper and lower edge portions of the associated side panel;

the portion of the dust flap between said cutout termination point and said intersection being sufficiently wide so as to strengthen the side panels against a vertical force tending to bow the side panels but sufficiently narrow so as to permit the dust flap to be folded in about said angled fold line.

2. The improved carrier end panel structure of claim 1, wherein the dust flap contains a score line between said cutout termination point and said intersection.

3. The improved carrier end panel structure of claim 1, wherein the dust flap contains slit means between said cutout termination point and said intersection.

4. The improved carrier end panel structure of claim 1, wherein the distance from said cutout termination point to said intersection is less than half the distance from said intersection to the end edge of the dust flap opposite the fold line.

5. The improved carrier end panel structure of claim 1, wherein the fold line along which the dust flap is connected to the lower end edge portion of a side panel extends to a lowermost point adjacent the bottom panel of the carrier.

6. The improved carrier end panel structure of claim 5, wherein the lower edge of the dust flap comprises a portion spaced a substantial distance from the bottom panel of the carrier, said spaced lower edge portion being connected to the lowermost point of the fold line by an edge extending diagonally to said spaced lower edge portion.

7. An open-ended carrier sleeve adapted to be loaded with articles having relatively narrow upper portions and relatively wide lower portions and to be formed into a closed carrier, comprising:

a relatively short top panel;

a relatively long bottom panel;

side panels foldably connected to the top and bottom panels, the side panels having lower end edge portions and upper end edge portions extending at an angle to each other so that the distance between the lower end edge portions at opposite ends of a side panel is greater than the distance between the upper end edge portions thereof;

a dust flap connected to the angled upper and lower end edge portions of each side panel along a correspondingly angled fold line, the dust flaps lying substantially in the plane of the associated side panel, the dust flaps on the same end of the carrier sleeve being adapted to be folded in toward each other along their fold lines;

an upper end flap connected to the top panel and lying substantially in the plane thereof, the upper end flap being adapted to be folded down into engagement with adjacent folded-in dust flaps;

a lower end flap connected to the bottom panel and lying substantially in the plane thereof, the lower end flap being adapted to be folded up into engagement with adjacent folded-in dust flaps;

each dust flap having an upper edge, a lower edge and an end edge; and the end edge of each dust flap containing a cutout extending toward the fold line and terminating at a point spaced from the intersection of the upper and lower end edge portions of the associated side panel;

the portion of each dust flap between said cutout termination point and said intersection being sufficiently wide so as to strengthen the side panels against a vertical force tending to bow the side panels but sufficiently narrow so as to permit the dust flap to be folded in about the angled fold line.

8. The open-ended carrier sleeve of claim 7, wherein the dust flap contains a score line between said cutout termination point and said intersection.

9. The open-ended carrier sleeve of claim 7, wherein the dust flap contains slit means between said cutout termination point and said intersection.

10. The open-ended carrier sleeve of claim 7, wherein the fold line along which the dust flap is connected to the lower end edge portion of a side panel extends to a lowermost point adjacent the bottom panel of the carrier sleeve, and wherein the lower edge of the dust flap comprises a portion spaced a substantial distance from the bottom panel of the carrier sleeve, said spaced lower edge portion being connected to the lowermost point of the fold line by an edge extending diagonally to said spaced-lower edge portion.

11. A blank for forming a sleeve-type carrier adapted to carry articles having relatively narrow upper portions and relatively wide lower portions, comprising:

a relatively long bottom panel section having end edges and side edges;

two side panel sections connected to the side edges of the bottom panel section along fold lines, each side panel section having a first end edge portion extending transversely from the fold line connecting the side panel section to the bottom panel section and a second end edge portion extending at an angle to the first end edge portion and intersecting the same so that the distance between the second end edge portions at opposite ends of a side panel section is less than the distance between the first end edge portions thereof;

relatively short top panel section means foldably connected to at least one of the side panel sections and having end edges and side edges;

a dust flap connected to the angled first and second end edge portions of each side panel section along a correspondingly angled fold line, the dust flaps on the same end of a carrier sleeve formed from the blank being adapted to be folded in toward each other along their angled fold lines;

an upper end flap connected to the end edges of the top panel section means, the upper end flaps being adapted to be folded down into engagement with adjacent folded-in dust flaps in a carrier sleeve formed from the blank;

a lower end flap connected to the end edges of the bottom panel section, the lower end flaps being adapted to be folded up into engagement with adjacent folded-in dust flaps in a carrier sleeve formed from the blank;

each dust flap having an upper edge, a lower edge and an end edge opposite said angled fold line; and the end edge of the dust flap containing a cutout extending toward the angled fold line connecting the dust flap to the first and second end edge portions of the side panel sections and terminating at a point spaced from the intersection of said first and second end edge portions;

the portion of the dust flap between said cutout termination point and said intersection being sufficiently wide so as to strengthen the side panels of a carrier sleeve formed from the blank against a vertical force tending to bow the side panels but sufficiently narrow so as to permit the dust flap to be folded in about its angled fold line.

12. The blank of claim 11, wherein the first end edge portion of each side panel section extends at substantially right angles to the fold line connecting the side panel section to the bottom panel section.

* * * * *